US005765070A

United States Patent [19]

Matsumoto

[11] Patent Number: 5,765,070

[45] Date of Patent: Jun. 9, 1998

[54] METHOD AND APPARATUS FOR PROCESSING LIGHT-SENSITIVE MATERIALS

[75] Inventor: Nobuo Matsumoto, Kanagawa, Japan

[73] Assignee: Fuji Photo Film Co., Ltd., Kanagawa, Japan

[21] Appl. No.: 764,271

[22] Filed: Dec. 12, 1996

[30] Foreign Application Priority Data

Dec. 14, 1995 [JP] Japan ..... 7-326053

[51] Int. Cl.[6] ..... G03D 3/08

[52] U.S. Cl. ..... 396/615; 396/616

[58] Field of Search ..... 396/566, 567, 396/578, 612, 615, 617, 620, 622, 626, 616

[56] References Cited

U.S. PATENT DOCUMENTS

| | | | |
|---|---|---|---|
| 3,462,221 | 8/1969 | Tajima et al. | 355/27 |
| 4,134,663 | 1/1979 | Laar et al. | 396/568 |
| 4,402,590 | 9/1983 | Rubin | 396/626 |
| 5,250,975 | 10/1993 | Beckmann et al. | 396/620 |
| 5,327,189 | 7/1994 | Wernicke et al. | 396/615 |
| 5,448,327 | 9/1995 | Eeles et al. | 396/615 |
| 5,475,464 | 12/1995 | De Cook et al. | 396/620 |
| 5,477,300 | 12/1995 | Fujimoto et al. | 396/615 |

FOREIGN PATENT DOCUMENTS

| | | | |
|---|---|---|---|
| 63-98664 | 4/1988 | Japan | G03D 3/08 |
| 4-503120 | 6/1992 | Japan | G03D 3/08 |
| 6-308675 | 4/1994 | Japan | G03C 5/26 |
| 6-214368 | 8/1994 | Japan | G03D 3/00 |
| 8-166665 | 6/1996 | Japan | 396/942 |
| WO 90/08981 | 8/1990 | WIPO | G03D 3/13 |

*Primary Examiner*—D. Rutledge

*Attorney, Agent, or Firm*—Sughrue, Mion, Zinn, Macpeak & Seas, PLLC

[57] ABSTRACT

A method and an apparatus for processing light-sensitive materials for efficiently processing a plurality of light-sensitive materials of different processing times are disclosed. A pair of movable guides and a pair of variable guide members are provided to feed a film for standard processing into a bleach-fixing bath after passing a first coloring development bath, and a film for rapid processing into the bleach-fixing bath after passing a second coloring development bath. Each processing bath and a drying section are variable in speed. In the case where the film for standard processing is processed in advance of the film for rapid processing, the processing rate of a predetermined processing bath is changed to suit the film for rapid processing after the trailing end of the film for standard processing passes through the particular processing bath along the direction in which the films are fed. The film for rapid processing starts to be fed at such a timing that the forward end thereof enters a drying section after the trailing end of the film for standard processing passes through the last feed rollers. As a result, the two types of film can be processed concurrently and efficiently within a short length of time.

20 Claims, 11 Drawing Sheets

PROCESS A, LE (FORWARD END IN TRANSPORT DIRECTION)
PROCESS A, TE (TRAILING END IN TRANSPORT DIRECTION)
PROCESS B2, LE
PROCESS B2, TE
PROCESS B1, LE
PROCESS B1, TE

METHOD AND APPARATUS FOR PROCESSING LIGHT-SENSITIVE MATERIALS

BACKGROUND OF THE INVENTION

1. Field of the Invention

The present invention relates a method and an apparatus for processing light-sensitive materials, in which a plurality of light-sensitive materials with different processing times can be developed efficiently.

2. Description of the Related Art

Conventional light-sensitive material processing apparatuses capable of changing the processing length with the change in the processing time, and such apparatuses capable of selecting one of a plurality of developing baths as desired are disclosed in JP-A-63-98664, JP-A-4-503120, JP-A-6-214368 and JP-A-6-308675.

These light-sensitive material processing apparatuses, however, are not designed to obviate the problem of interference between plural types of light-sensitive materials having different processing times while being processed, and therefore have a considerable practical limit in applications to a plurality of light-sensitive materials being processed with different processing times.

The light-sensitive material processing apparatus disclosed in JP-A-63-98664 is intended to select the feed rate of a light-sensitive material according to the image-forming speed in an exposure section and to select the transport path of the light-sensitive material according to the feed rate. This light-sensitive material processing apparatus is aimed at keeping a constant processing time regardless of the feed rate, and has no measure taken for processing light-sensitive materials of different processing times. This apparatus, therefore, is incapable of processing light-sensitive materials of plural different types at a time. Suppose a light-sensitive material of slow processing rate is processed first, followed by processing a light-sensitive material of higher processing rate. The feed rate would be required to be changed after delivery of the light-sensitive material of slow processing rate before the light-sensitive material of higher processing rate is processed. This requires a considerable waiting time and is inefficient.

In the processing apparatus disclosed in JP-A-4-503120, a light-sensitive material is processed while being circulated in a processing bath in order to reduce the access time (dry-to-dry time) although the processing apparatus is small in processing capacity, and includes no means for processing a plurality of light-sensitive materials of different processing times at the same time. As described above, in the case where a light-sensitive material of slow processing rate is processed first and then a light-sensitive material of higher processing rate, therefore, the feed rate is required to be changed after delivery of the light-sensitive material of slow processing rate, followed by processing the light-sensitive material of higher processing rate, with the result that a considerable waiting time is required inefficiently.

The processing apparatus disclosed in JP-A-6-214368, on the other hand, is capable of selecting one of a plurality of development baths containing color developers of different photographic characteristics on the basis of the processing information included in a particular light-sensitive material or a cartridge (patron) thereof. Consequently, light-sensitive materials of different processing times can be processed optimally in different developers. In spite of this, the apparatus fails to take any measure for solving the problems of superposition (interference) between the light-sensitive materials or reducing the waiting time when these light-sensitive materials are continuously processed in different manners.

The processing apparatus disclosed in JP-A-6-308675, on the other hand, is intended to reduce the number of processing baths by reducing the two washing steps to a single common step in the process series of development, washing, bleaching, fixing and washing, for example. Nevertheless, this apparatus also lacks the measure for processing light-sensitive materials of different processing times at a time. In the case where a light-sensitive material of high processing rate is processed immediately after a light-sensitive material of low processing rate as mentioned above, therefore, the requirement of changing the feed rate after delivery of the slow light-sensitive material before processing the fast light-sensitive material results in a considerable waiting time, thereby making the operation inefficient.

As described above, the conventional light-sensitive material processing apparatuses fail to take any action for processing light-sensitive materials of different processing times or reducing the waiting time or against the interferences which may be encountered in successively processing different types of light-sensitive materials. In the case where a light-sensitive material of high processing rate is processed after a light-sensitive material of slow processing rate, therefore, the light-sensitive material of higher processing rate can start to be processed only after the light-sensitive material of slow processing rate has actually been delivered. Consequently, the conventional apparatuses are unable to make the most of the advantage of a light-sensitive material of high processing rate.

SUMMARY OF THE INVENTION

In view of the above-mentioned facts, the object of the present invention is to provide a light-sensitive material processing method and a light-sensitive processing apparatus capable of efficiently processing plural types of light-sensitive materials having different processing times in a single processing means.

According to a first aspect of the invention, there is provided a light-sensitive material processing method for processing at least two types of light-sensitive materials of different processing specifications, comprising the steps of producing a specification of a first light-sensitive material fed ahead of a second light-sensitive material to be processed, information on the transport path of the first light-sensitive material, a specification of the second light-sensitive material, information on the transport path of the second light-sensitive material and trailing end position information of the preceding first light-sensitive material, calculating the time to start processing the second light-sensitive material in such a manner as to minimize the processing interval between the first light-sensitive material and the second light-sensitive material on the basis of the specifications and the transport path information of the first and second light-sensitive materials and the trailing end position information of the first light-sensitive material, and starting the processing of the second-light sensitive material on the basis of the result of the calculation.

The trailing end position information of the first light-sensitive material is defined as the one indicating the trailing end position along the direction of transportation of the first light-sensitive material on the transport path. Also, the specification of the light-sensitive materials includes at least the processing time and the total length of the light-sensitive materials. The transport path information include at least the position and length of the transport path and the feed rate.

In the method of processing the light-sensitive material according to the first aspect of the invention, first, the trailing end position of the preceding first light-sensitive material on the transport path is calculated from the specification of the first light-sensitive material including the processing time, the total length and the processing start time of the first light-sensitive material. Then, the processing start time of the second light-sensitive material is calculated in such a manner as to minimize the processing interval between the first light-sensitive material and the second light-sensitive material on the basis of the trailing end position information along the direction of transportation of the first light-sensitive material on the transport path, the specification of the first light-sensitive material, the transport path information of the first light-sensitive material fed on the transport path, the specification of the second light-sensitive material, the transport path information of the second light-sensitive material fed on the transport path and the processing start time of the preceding first light-sensitive material. The second light-sensitive material begins to be processed on the basis of the result of this calculation, so that the first light-sensitive material and the second light-sensitive material are delivered from the light-sensitive material processing apparatus with a minimum interval.

According to a second aspect of the invention, there is provided a light-sensitive material processing apparatus for processing at least two types of light-sensitive material of different processing times, in which the means for transporting the light-sensitive materials is divided into a plurality of blocks along the direction of transportation, and the feed rate is changeable for each block.

In the light-sensitive material processing apparatus according to the second aspect of the invention, light-sensitive material transport means can change the feed rate for each block. Therefore, the feed rate can be set to a low level for a block transporting a light-sensitive material of long processing time, and to a high level for a block transporting a light-sensitive material of short processing time. In the case where a light-sensitive material of long processing time is fed ahead of a light-sensitive material of short processing time, therefore, a plurality of light-sensitive materials of different processing times can be processed concurrently in a single light-sensitive material processing apparatus by progressively changing the feed rates of the respective blocks. As a result, two or more types of light-sensitive materials of different processing times can be continuously processed over at least one intermediate block between them. In the conventional light-sensitive material processing apparatus, by contrast, the feed rate is changed for the whole apparatus, and therefore, a light-sensitive material of one processing time cannot start to be processed before completing the processing of a light-sensitive material of another processing time.

According to a third aspect of the invention, there is provided a light-sensitive material processing apparatus for processing at least two types of light-sensitive materials of different processing times, comprising a plurality of processing baths for storing solutions for processing light-sensitive materials, first transport means for transporting the light-sensitive materials in a predetermined order through the processing baths, and second transport means arranged in parallel with the first transport means for transporting the light-sensitive materials in such a manner as to skip a predetermined one of the processing baths.

The light-sensitive material processing apparatus according to the third aspect of the invention comprises the first transport means for transporting the light-sensitive materials through a plurality of processing baths in a predetermined order and the second transport means arranged in parallel with the first transport means for transporting the light-sensitive materials in such a manner as to skip a predetermined one of the processing baths. Assume that a light-sensitive material of long processing time is processed in advance of a light-sensitive material of short processing time and that the light-sensitive material of long processing time is transported through the processing bath in the portion of the first transport means parallel to the second transport means while the succeeding light-sensitive material of short processing time is fed through the second transport means. Then, the succeeding light-sensitive material of short processing time can outrun the light-sensitive material of long processing time, thereby reducing the whole processing time.

According to a fourth aspect of the invention, there is provided a method of processing at least two types of light-sensitive materials of different processing times, comprising the step of processing light-sensitive materials of short processing time in advance of light-sensitive materials of long processing time.

In the method of processing light-sensitive materials according to the fourth aspect of the invention, light-sensitive materials of short processing time (such as a light-sensitive material for rapid processing) can be processed in advance of light-sensitive materials of long processing time. The light-sensitive materials of short processing time can thus be completely processed earlier. It is therefore possible to make the most of the advantage of developing light-sensitive materials of short processing time at an early time.

As described above, the present invention has the superior advantage that a plurality of light-sensitive materials having different processing times can be processed efficiently.

The above and other objects, features and advantages of the present invention will become apparent from the following description and the appended claims taken in conjunction with the accompanying drawings in which preferred embodiments of the present invention are shown by way of illustrative example.

BRIEF DESCRIPTION OF THE DRAWINGS

The invention will now be described with reference to the accompanying drawings wherein.

DESCRIPTION OF THE PREFERRED EMBODIMENTS

[First embodiment]

Figure 1:
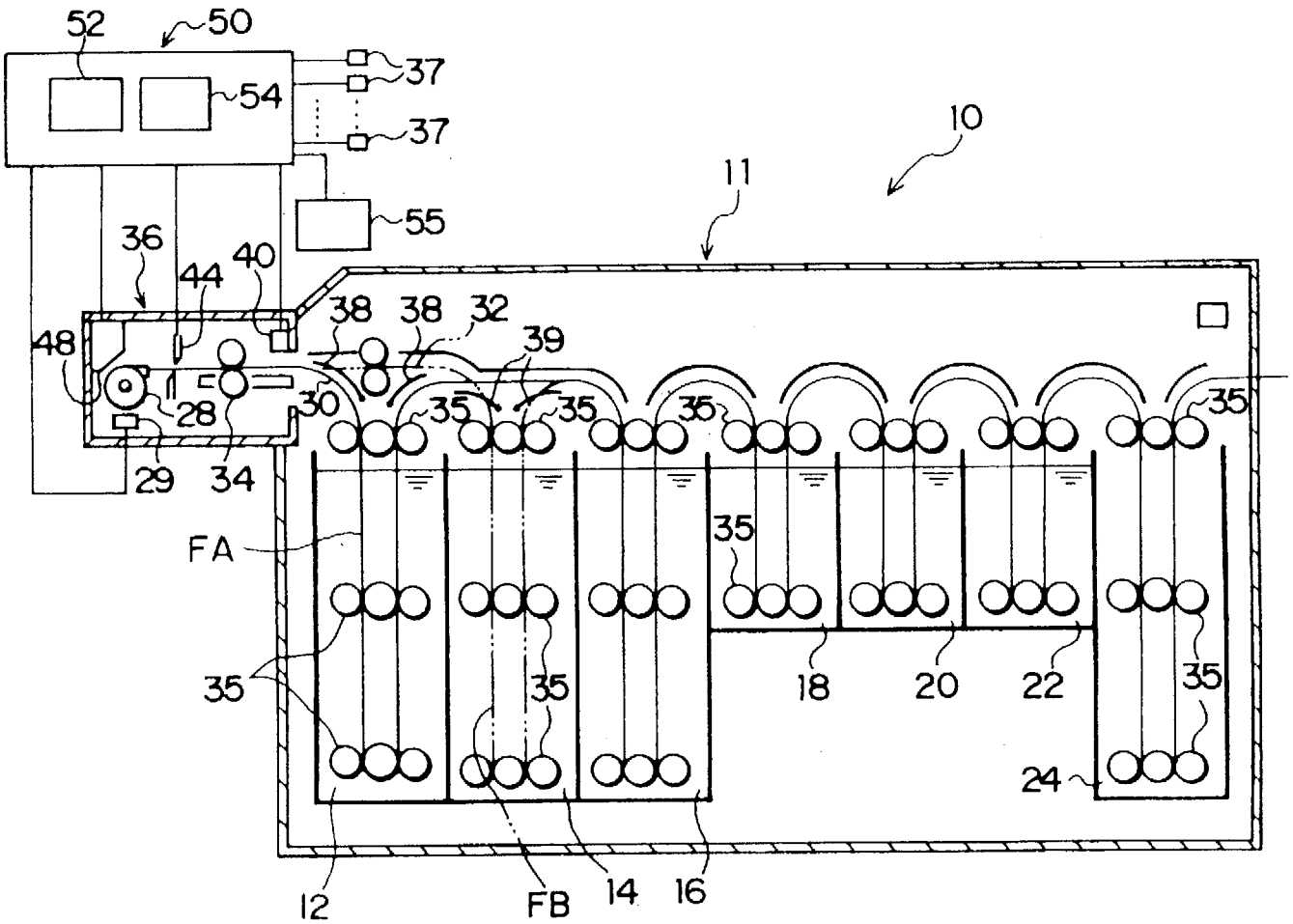
FIG. 1 is a diagram schematically showing a configuration of a light-sensitive material processing apparatus according to a first embodiment of the invention.

FIG. 1 is a sectional view schematically showing a light-sensitive material processing apparatus according to a first embodiment of the present invention.

A light-sensitive material processing apparatus 10 is adapted to process two different types of films FA and FB with two appropriate developers, respectively.

According to this embodiment, the apparatus can process the film FA for standard processing which is generally used for photography, and the film FB for rapid processing which can be more rapidly developed than a standard development process.

A processing section 11 of the light-sensitive material processing apparatus 10 includes a first coloring development bath 12, a second coloring development bath 14, a bleach-fixing bath 16, a first stabilization bath 18, a second stabilization bath 20, a third stabilization bath 22 and a drying bath 24 arranged in that order.

The first coloring development bath 12 contains a first coloring developer for standard processing, and the second coloring development bath 14 contains a second coloring developer which is shorter in processing time than the standard developer. The bleach-fixing bath 16, on the other hand, contains a bleach-fixer. The first stabilization bath 18, the second stabilization bath 20 and the third stabilization bath 22 contain a stabilizer, respectively. Each bath and the drying section 24 includes a plurality of feed rollers 35. These feed rollers 35 are rotated by a film feed motor 37. According to this embodiment, each processing bath and the drying section 24 are equipped with an independent film feed motor 37 controlled by a control unit 50 so that the rotational speed of each feed motor is variable independently.

A transport path 30 for introducing the film FA to the first coloring development bath 12 and a transport path 32 for introducing the film FB to the second coloring development bath 14 are arranged above the first coloring development bath 12.

A pair of movable guide members 38 driven by a driving unit not shown are arranged above the first coloring development bath 12. The driving unit (not shown) for driving each movable guide member 38 is controlled by the control unit 50. The movable guide member 38 is adapted to guide the film FA transported to the processing section 11 to the transport path 30, and the film FB transported to the processing section 11 to the transport path 32.

Figure 4B:
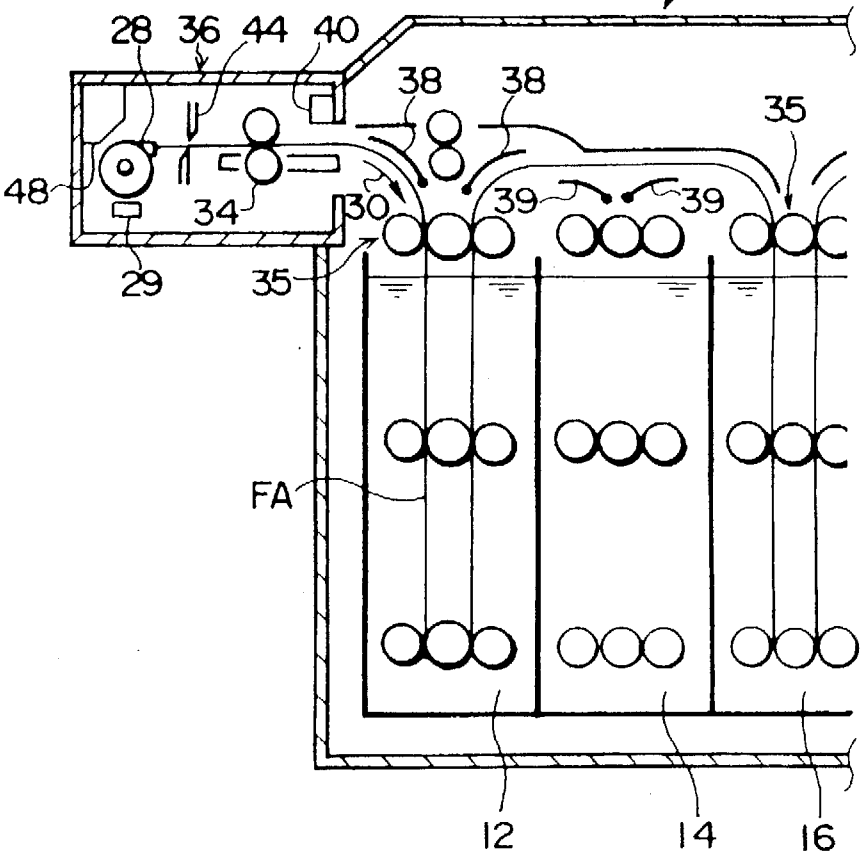
FIG. 4B is a sectional view of a light-sensitive material processing apparatus showing a transport path of a film for standard processing.
Figure 4A:
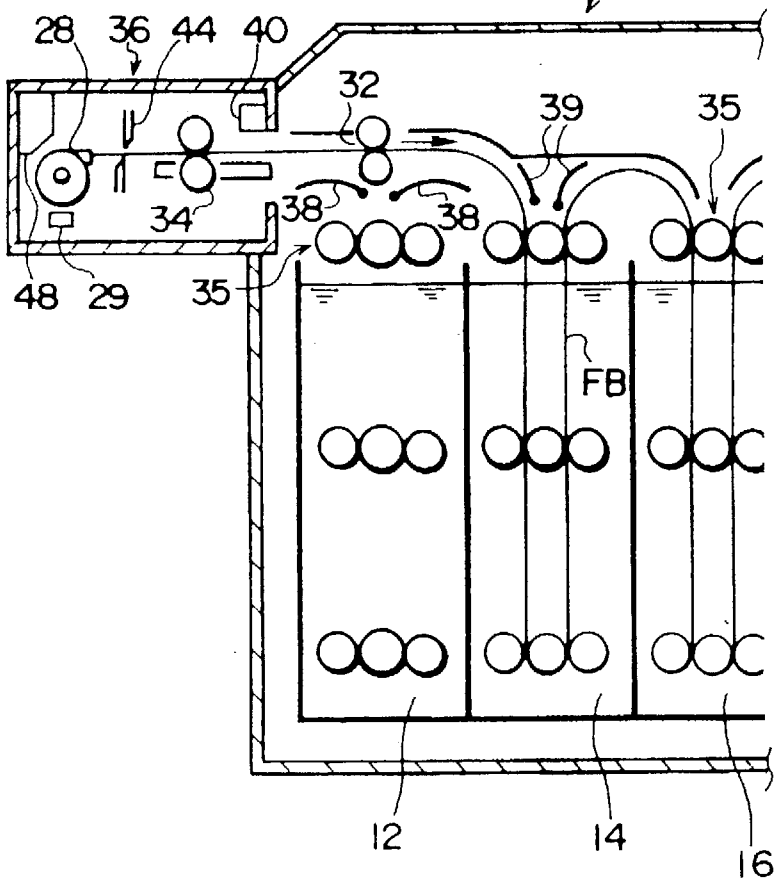
FIG. 4A is a sectional view of a light-sensitive material processing apparatus showing a transport path of a film for rapid processing.

Further, a pair of variable guide members 39 are arranged above the second coloring development bath 14. The driving unit for driving the movable guide members 39 is controlled by the control unit 50. The movable guide members 39 are switched between the mode in which the film FB transported from the transport path 32 enters or leaves the second coloring development bath 14 as shown in FIG. 4A and the mode in which the film FA processed in the first coloring development bath 12 is guided to the bleach-fixing bath 16 as shown in FIG. 4B in cooperation with the movable guide members 38.

The composition of each processing solution is shown in Tables 1 to 4 below. (The tank solution in the tables indicates the solution stored in the processing baths, and the refilling solution means the solution to be refilled in the processing baths.)

TABLE 1

| First coloring developer (for film FA) | Tank solution (g) | Refilling solution (g) |
|---|---|---|
| Diethylenetriamin pentaacetate | 5.0 | 6.0 |
| Sodium sulfite | 4.0 | 5.0 |
| Potassium carbonate | 30.0 | 37.0 |
| Potassium bromide | 1.3 | 0.5 |
| Potassium arsenide | 1.2 mg | — |
| Hydroxylamin sulfate | 2.0 | 3.6 |
| 4-[N-ethyl-N-(β-hydroxylethyl) amino]-2-methylaniline sulfate | 4.7 | 6.2 |
| Water added | 1.0 liter | 1.0 liter |

TABLE 2

| Second coloring developer (for film FB) | Tank solution (g) | Refilling solution (g) |
|---|---|---|
| Diethyltriamin pentaacetate | 2.0 | 2.0 |
| 1-hydroxy ethylidene-1,1-diphosphonic acid | 2.0 | 2.0 |
| Sodium sulfite | 3.9 | 5.1 |
| Potassium carbonate | 37.5 | 39.0 |
| Potassium bromide | 1.5 | — |
| Potassium arsenide | 1.3 mg | — |
| N-hydroxy-(N,N-bissulfonate methyl)hydroxylamin | 5.0 | 10.0 |
| 2-methyl-4-[N-ethyl-N-(β-hydroxyethyl)amino]aniline sulfate | 6.0 | 10.0 |
| Water added | 1.0 liter | 1.0 liter |
| pH (adjusted with potassium hydroxide and sulfuric acid) | 10.15 | 10.25 |

TABLE 3

| Bleach-fixer (For both films FA and FB) | Tank solution (g) | Refilling solution (g) |
|---|---|---|
| Ethylenediamin-(2-carboxy phenyl)-N,N',N'-triacetate | 0.16 mol | — |
| Ethylenediamin tetraacetate | 0.03 mol | — |
| Iron chloride | 0.16 mol | — |
| Ammonium bromide | 70 | 105 |
| Ammonium nitrate | 14 | 21 |
| Succinic acid | 0.15 mol | 0.15 mol |
| Ammonium sulfite | 19 | 57 |
| Thio-ammonium sulfate aqueous solution (700 g/l) | 280 ml | 840 ml |
| Isodazol | 15 | 45 |
| p-aminosulfonic acid | 0.15 mol | 0.20 mol |
| Water added | 1.0 liter | 1.0 liter |
| pH (adjusted with ammonium water and acetic acid) | 5.0 | 4.5 |

TABLE 4

| Stabilizer (for films FA, FB, tank solution and refilling solution) | In gram |
|---|---|
| p-toluene sodium sulfonate | 0.03 |
| Polyoxyethylene-p-monononiphenyl ether (average polymerization degree 10) | 0.2 |
| Ethylenediamin tetraacetate di-sodium salt | 0.05 |
| 1,2,4-triazol | 1.3 |
| 1,4-bis(1,2,4-triazol-1-ilmethyl)piperazine | 0.75 |
| Succinin acid | 0.03 mol |
| Water added | 1.0 liter |
| pH | 5.5 |

The drying section 24 includes hot air generating means having a heater and a fan for drying the wet films FA, FB by applying hot air thereto.

A film loader 36 is disposed on the first coloring development bath 12 side of the processing section 11.

The cartridge 28 containing an imaged film is loaded in the film loader 36 by opening a cover not shown. The film loader 36 includes a detection switch 29 for detecting the presence or absence of the cartridge 28. The detection switch 29 is connected to a control unit 50 (not shown in FIGS. 4A, 4B. See FIG. 1).

The film loader 36 also includes feed rollers 34. The feed rollers 34 holding between them the forward ends of the films FA, FB projected from the loaded cartridge 28 are rotated, thereby reeling out the films FA, FB to the processing section 11. The films FA, FB are finally cut off by the cutter 44 and separated from the cartridge 28.

Figure 2:
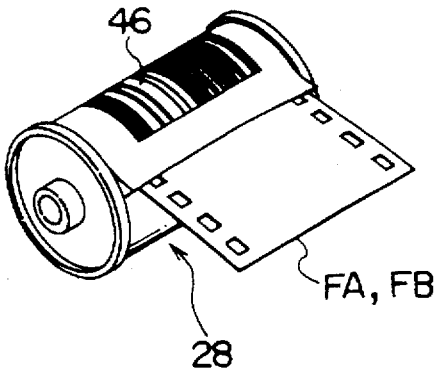
FIG. 2 is a perspective view of a cartridge (patrone)

The feed rollers 34 and the cutter 44 are controlled by the control unit 50 (FIG. 1). As shown in FIG. 2, a bar code 46 providing information carrying means is attached on the outer surface of the cartridge 28 for carrying information to identify the films FA, FB and other information relating to the films FA, FB such as the sensitivity, the development method, quantities and length.

As shown in FIG. 1, a light-reflection type of bar code reader-sensor 48 is arranged in opposed relation to the bar code 46 (not shown in FIG. 1) in the neighborhood of the cartridge 28 loaded in the loader 36.

In place of the bar code 46, a conductive portion or an uneven portion providing a CAS code may be attached on the cartridge 28. A magnetic recording portion may be provided as another alternative. In these cases, the light-reflection type of bar code reader-sensor 48 is replaced by a reader-sensor corresponding to the particular information-carrying method. Also, the location where information-carrying means such as the bar code 46 is attached is not limited to the shown place, but may be anywhere on the outer surface of the cartridge 28. It may be, for example, the forward portions of the films FA, FB, the reader portion connected to the films FA, FB, or a magnetic track, if any, formed on the films FA, FB. The information relating to the films FA, FB read by the bar code reader-sensor 48 is supplied to the control means 50 described later and used for controlling the transport system.

The film loader 36 includes an infrared sensor 40 arranged in the vicinity of the feed rollers 34 for detecting the films FA, FB. The infrared sensor 40 can detect the trailer side end of films FA, FB (the side thereof engaging the spool shaft of the cartridge 28) and the leader side end (the side far from the trailer) of the films FA, FB. The detection signal from the infrared sensor 40 is applied to the control means 50 for controlling the transport system.

The control means 50 has a storage means 52 and a calculation means 54 built in it. The storage means 52 stores the information on the prescription for processing the films and the length of the transport paths through which the films FA, FB are passed. The control means 50 calculates and determines the transport path, the feed rate and the timing to start the transportation on the basis of the information read by the bar code reader-sensor 48. Since such information as the length of the transport path through which the films FA, FB are passed is stored in memory in advance, the control means 50 can determine the position of the forward and rear ends of the films FA, FB along the direction of transportation thereof from the feed rate and the time when the leader side end and the trailer side end of the films FA, FB are detected by the infrared sensor 40. The control means 50 can also measure the actual length of the films.

The processing time for each process and the temperature of each processing solution are shown in Tables 5 and 6 below. According to this embodiment, the film FB is fed three times as rapidly as the film FA.

TABLE 5

Processing steps of film FA

| Step | Processing time | Processing temp. |
|---|---|---|
| Coloring development | 3 min 15 sec | 37.8° C. |
| Bleach-fixing | 3 min | 40° C. |
| Stabilization (1) | 40 sec | 40° C. |
| Stabilization (2) | 40 sec | 40° C. |
| Stabilization (3) | 40 sec | 40° C. |
| Drying | 2 min | 80° C. |

TABLE 6

Processing steps of film FB

| Step | Processing time | Processing temp. |
|---|---|---|
| Coloring development | 1 min | 45° C. |
| Bleach-fixing | 1 min | 40° C. |
| Stabilization (1) | 13.3 sec | 40° C. |
| Stabilization (2) | 13.3 sec | 40° C. |
| Stabilization (3) | 13.3 sec | 40° C. |
| Drying | 40 sec | 80° C. |

The control means 50 is connected with the infrared sensor 40, the driving motor for driving the movable guide members 38 and the film feed motor.

Figure 3A:
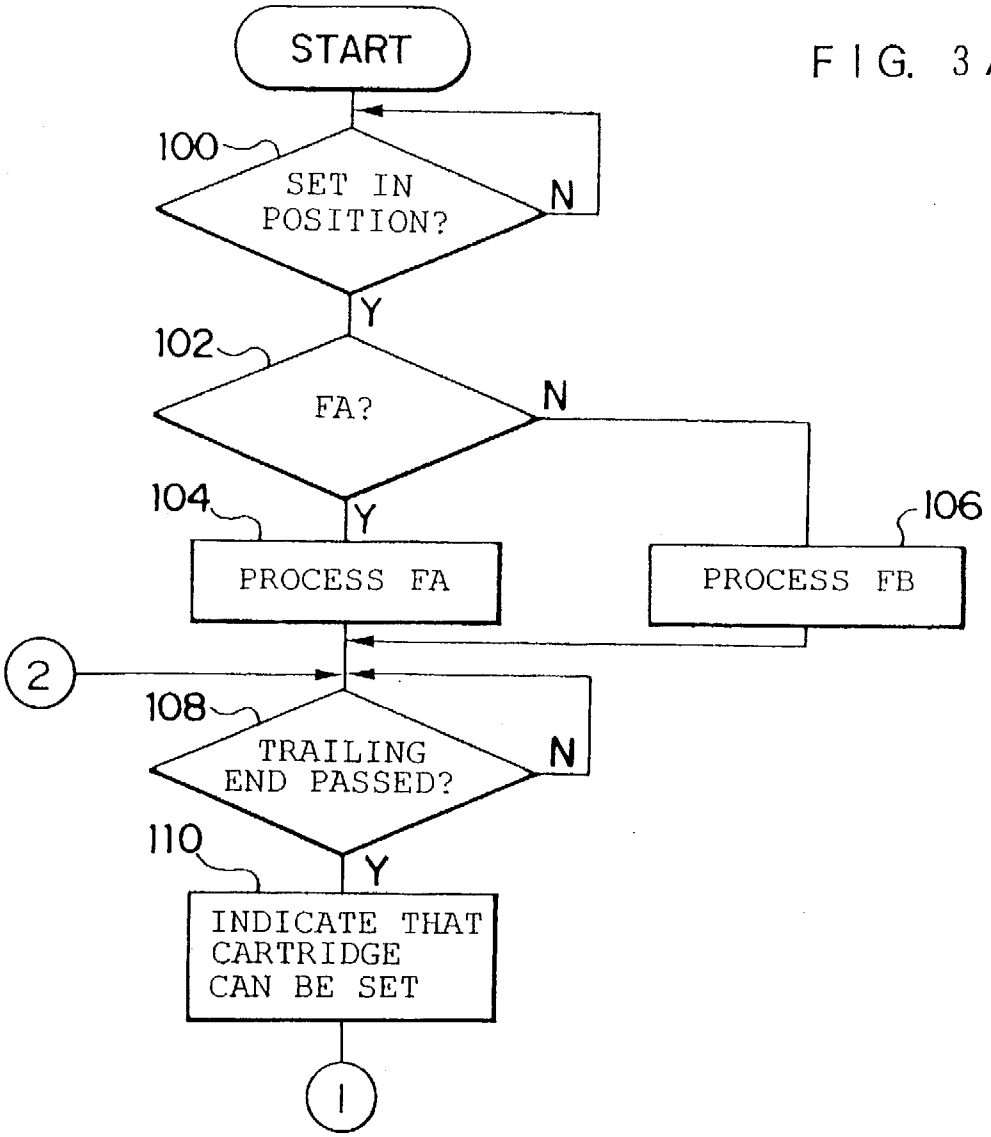
FIGS. 3A and 3B are a flowchart for explaining the control procedure according to the first embodiment.
Figure 3B:
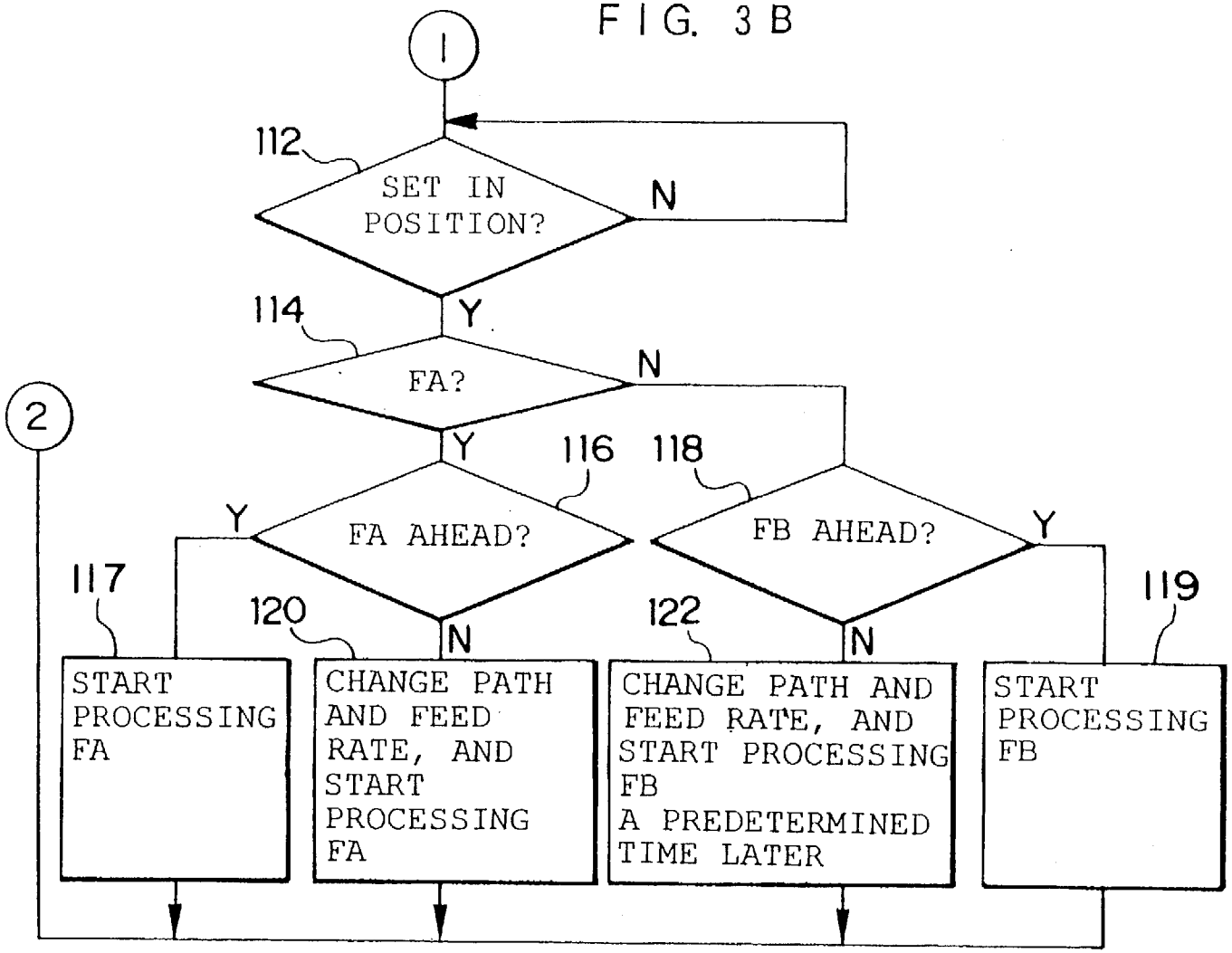

Now, the operation of the present embodiment will be explained with reference to the flowchart of FIGS. 3A and 3B.

Step 100 decides whether or not the cartridge 28 is set in position. Upon decision that the cartridge 28 has been set in position, the process is passed to step 102 for reading the information of the bar code 46 attached on the cartridge 28 by the bar code reader-sensor 48 to identify the film type. In the case where the film is determined as FA type for standard processing, the process proceeds to step 104, while when the film is of FB type for rapid processing, the process proceeds to step 106.

In step 104, the film FA is entirely reeled out from the cartridge 28, and the trailer side of the film FA is cut off by the cutter 44 to separate the film FA from the cartridge 28. Also, the movable guide members 38 and the movable guide members 39 are set as shown in FIG. 4B. The film feed rates in the bleach-fixing bath 16, the first stabilization bath 18, the second stabilization bath 20, the third stabilization bath 22 and the drying section 24 are set in accordance with the specification of the film FA. The first coloring development bath 12 passes only the film FA and therefore the film feed rate in the coloring development bath 12 is fixed in accordance with the specification of the film FA.

In step 106, the film FB is entirely supplied from the cartridge 28, and the trailer side of the film FB is cut off by the cutter 44 thereby to separate the film FB from the cartridge 28. Also, the movable guide members 38 and the movable guide members 39 are set as shown in FIG. 4A. The film feed rates in the bleach-fixing bath 16, the first stabilization bath 18, the second stabilization bath 20, the third stabilization bath 22 and the drying section 24 are set in accordance with the specification of the film FB. The second coloring development bath 14 passes only the film FB and therefore the film feed rate in the coloring development bath 14 is fixed in accordance with the specification of the film FB.

Step 108 decides whether or not the trailing end of the film along the transport direction thereof is detected by the infrared sensor 40. In the case where the trailing end of the film along the transport direction thereof is detected by the infrared sensor 40, the process proceeds to step 110 for indicating that the next cartridge 28 can be set in position on a display unit 55 coupled to the control unit 50.

Step 112 decides whether or not the next cartridge 28 has been set in position, and if the decision is affirmative, the process proceeds to step 114.

In step 114, the information of the bar code 46 attached on the cartridge 28 is read by the bar code reader-sensor 48 thereby to identify the film type. In the case where the decision is that the film is of FA type for standard processing, the process proceeds to step 116, while if the decision is that the film is of FB type for rapid processing, the process is passed to step 118.

Step 116 identifies the type of the preceding film. In the case where the preceding film is of FA type for standard processing, step 117 starts processing (supplying and cutting off) the film FA. Then the process is returned to step 108. In the case where the decision is that the film is of FB type for rapid processing, on the other hand, the process proceeds to step 120.

In step 120, the movable guide members 38 are driven to guide the film FA to the leading path 30. The feed rates of the film in the bleach-fixing bath 16, the first stabilization bath 18, the second stabilization bath 20, the third stabilization bath 22 and the drying section 24 are set in accordance with the specification of the film FA after the trailing end of the preceding film FB has passed the last feed rollers 35 of each processing bath or the drying section 24 (in other words, the film FA and the film FA are not processed at the same time in the same processing section). The film FA is delivered from the cartridge 28 in its entirety, and the trailer side thereof is cut off by the cutter 44 thereby to separate the film FA from the cartridge 28. In this way, in the case where the preceding film is of FB type for rapid processing, and the succeeding film is of FA type for standard processing, the film FA can begin to be processed as soon as the trailing end of the film FB along the transport direction thereof is inserted in the processing section 11.

Step 118, on the other hand, identifies the type of the preceding film. In the case where the decision is that the preceding film is of FA type for standard processing, the process proceeds to step 122, while if the decision is that the preceding film is of FB type for rapid processing, the film FB begins to be processed (reeled out and cut off) in step 119 followed by returning to step 108.

In step 122, the movable guide members 38 are driven to guide the film FB to the leading path 32. The feed rates of the film in the bleach-fixing bath 16, the first stabilization bath 18, the second stabilization bath 20, the third stabilization bath 22 and the drying section 24 are set in accordance with the specification of the film FB after the trailing end of the preceding film FA has passed the last rollers 35 of each processing bath or the drying section 24. The film FB is delivered in it entirety from the cartridge 28, and the trailer side thereof is cut off by the cutter 44 thereby to separate the film FB from the cartridge 28. In this way, in the case where the preceding film is of FA type for standard processing, and the succeeding film is of FB type for rapid processing, the film FB begins to be processed in such a manner that the forward end of the film FB along the transport direction thereof is inserted in the drying section 24 after the trailing end of the film FA along the transport direction thereof has passed the last feed rollers 35 of the drying section 24 constituting the longest path driven by a single driving source.

Figure 5A:
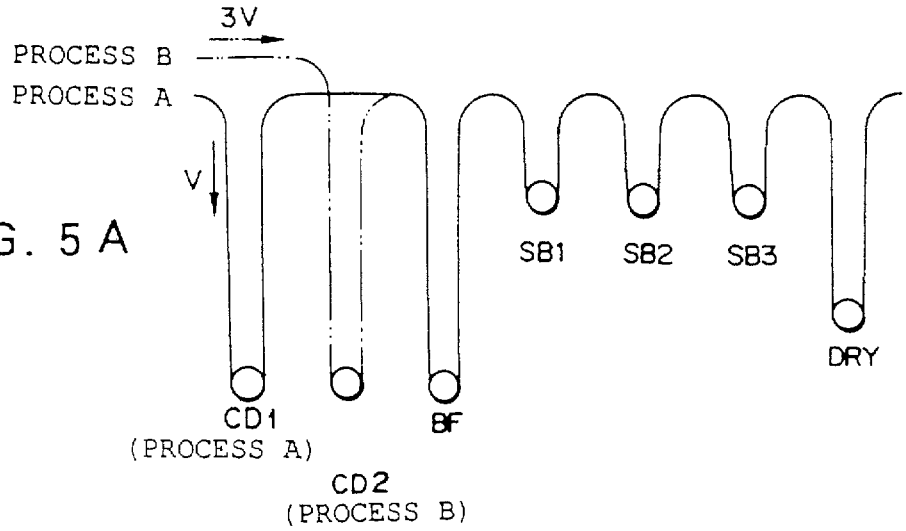
FIGS. 5A and 5B are diagrams for explaining the manner in which light-sensitive materials are fed in a light-sensitive material processing apparatus according to the first embodiment.
Figure 5B:
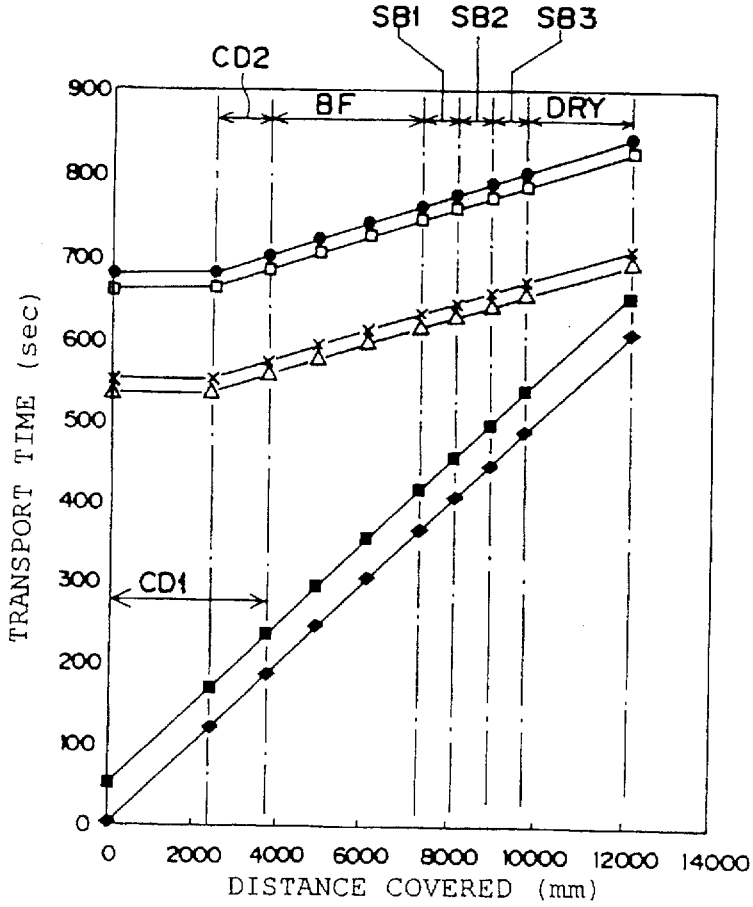

In the case where the film FB begins to be processed after the film FA, the conventional apparatus is required first to change the feed rate after delivery of the film FA and then is required to begin to process the film FB, and therefore cannot take full advantage of the feature of the film FB for rapid processing. According to the present embodiment comprising two coloring development baths, by contrast, the feed rate at each section can be changed independently. Even in the case where the film FB for rapid processing begins to be processed after the film FA for standard processing, therefore, both films can be processed concurrently. It is thus possible to complete the whole processing within as short a time as shown by processes A and B2 in the graphs of FIGS. 5A and 5B. The feature of the rapid-processing film FB can thus be fully utilized. Character CD1 in FIGS. 5A and 5B designates the first coloring development bath 12, character CD2 the second coloring development bath 14, character BF the bleach-fixing bath 16, character SB1 the first stabilization bath 18, character SB2 the second stabilization bath 20, character SB3 the third stabilization bath 22 and character DRY the drying section 24.

[Second embodiment]

Now, a second embodiment of the invention will be explained with reference to FIGS. 6, 7A, 7B, 8A, 8B. The same component parts as those in the above-mentioned embodiments are designated by the same reference numerals, respectively, and will not be described any further.

Figure 6:
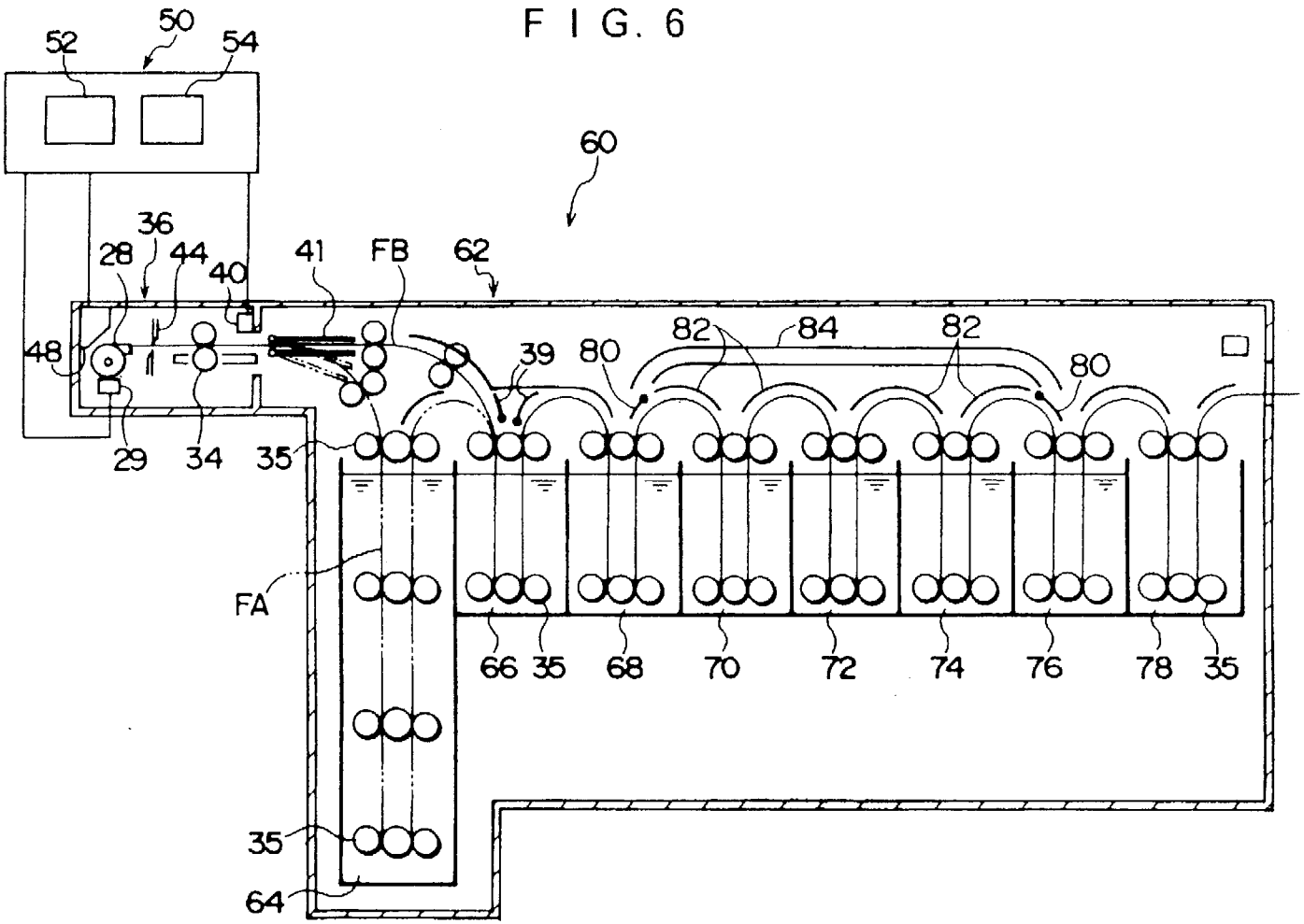
FIG. 6 is a diagram schematically showing a light-sensitive material processing apparatus according to a second embodiment.

As shown in FIG. 6, a processing section 62 of a light-sensitive material processing apparatus 60 according to the second embodiment includes a first coloring development bath 64, a second coloring development bath 66, a first bleach-fixing bath 68, a second bleach-fixing bath 70, a third bleach-fixing bath 72, a first stabilization bath 74, a second stabilization bath 76 and a drying section 78 arranged in that order.

The first coloring development bath 64 contains a first developer for standard processing, and the second coloring development bath 66 contains a second developer of shorter processing time than the standard developer. Also, the bleach-fixer is contained in the first bleach-fixing bath 68, the second bleach-fixing bath 70 and the third bleach-fixing bath 72, while the stabilizer is contained in the first stabilization bath 74 and the second stabilization bath 76.

According to this embodiment, the light-sensitive material is fed in the first coloring-development bath 64 three times longer in distance than in the second coloring-development bath 66.

According to this embodiment, the movable guide member 41 including a pair of guide plates is adapted to guide the film FA to the first coloring-development bath 64, and the film FB to the second coloring-development bath 66.

A variable guide member 80 is disposed at the film outlet side of the first bleach-fixing bath 68 and at the film inlet side of the second stabilization bath 76. The movable guide member 41 and the variable guide member 80 are controlled by the control unit 50.

Also, an arcuate first fixed guide 82 is arranged above each of the first bleach-fixing bath 68, the second bleach-fixing bath 70, the third bleach-fixing bath 72, the first stabilization bath 74 and the second stabilization bath 76.

A second fixed guide 84 is arranged above the first fixed guide 82 for guiding toward the inlet of the second stabilization bath 76 the film FB transported upward from the first bleach-fixing bath 68.

Figure 7A:
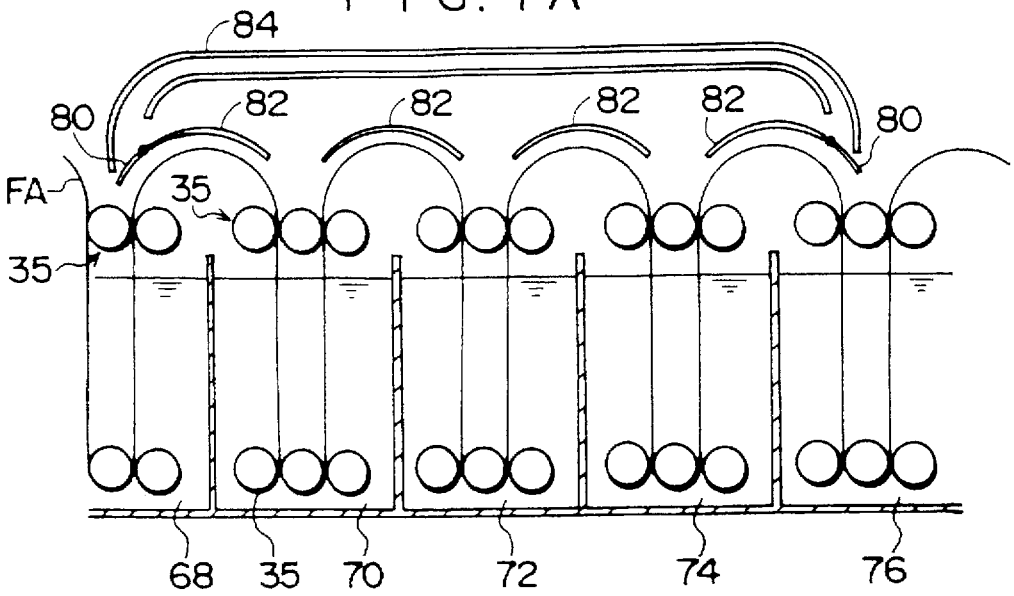
FIG. 7A is a sectional view of a light-sensitive material processing apparatus showing the transport path of a film for standard processing.

The variable guide member 80 includes a guide plate which is rotated a predetermined angle by a driving unit not shown. In the case where the film FA is transported, as shown in FIG. 7A, the variable guide member 80 is set diagonally. Thus, the film FA, after being delivered from the first bleach-fixing bath 68, is processed sequentially in the second bleach-fixing bath 70, the third bleach-fixing bath 72, the first stabilization bath 74 and the second stabilization bath 76.

Figure 7B:
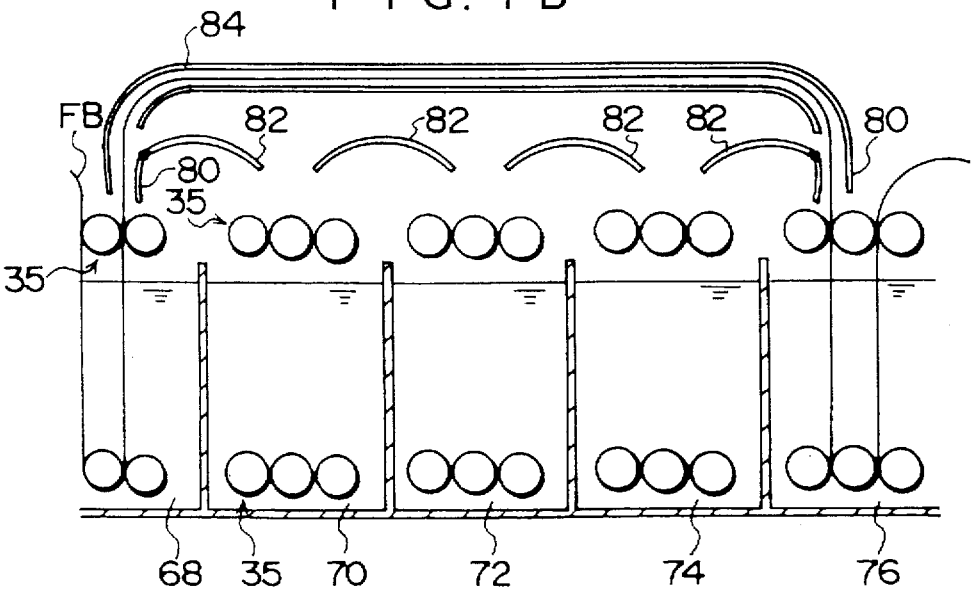
FIG. 7B is a sectional view of a light-sensitive material processing apparatus showing the transport path of a film for rapid processing.

In the case of transporting the film FB, on the other hand, as shown in FIG. 7B, the variable guide member 80 is set substantially vertically. The film FB, after being delivered out of the first bleach-fixing bath 68, passes through a bypass formed by the second fixed guide 84 into the second stabilization bath 76.

According to this embodiment, the film FA for standard processing and the film FB for rapid processing are set to the same feed rate.

Now, the operation of this embodiment will be explained.

In this embodiment, assume that the film FB for rapid processing is fed first, followed by the film FA for standard processing. After the trailing end of the film FB for rapid processing along the transport direction thereof is inserted in the processing section 62, the film FA can begin to be processed immediately.

The variable guide members 80 are first set as shown in FIG. 7B, and after the passage of the trailing end of the film FB along the direction of transportation thereof, are sequentially moved to permit the processing of the next film FA. In this case, the film FA begins to be delivered a predetermined time after the film FB is delivered from the drying section 78.

Assume, on the other hand, that the film FA for standard processing is fed first, and then the film FB for rapid processing. The light-sensitive material processing apparatus 60 according to this embodiment can deliver the film FB almost immediately after the film FA. In the process, the control unit 50 calculates the position of the trailing end of the film FA along the direction of transportation thereof (the present position of the trailing end can be determined from the feed rate and the time when the film FA passes the infrared sensor 40). The film FB thus begins to be transported at such a timing that there is substantially no spatial interval between the trailing end of the film FA just entering the second stabilization bath 76 and the forward end of the film FB along the direction of transportation thereof. In other words, the control means 50 begins to process the film FB after a time interval at least equivalent to the processing time in the first coloring development bath 64 minus the processing time in the second coloring development bath 66 plus the processing time in the second bleach-fixing bath 70 plus the processing time in the third bleach-fixing bath 72 plus the processing time in the first stabilization bath 74 (See the processes A and B3 in the graph of FIG. 8B), since the trailing end of the film FA for standard processing along the direction of transportation thereof was inserted into the processing section 62.

Also, according to the present embodiment comprising the variable guide member 80 and the second fixed guide 84 capable of bypassing the second bleach-fixing bath 70, the third bleach-fixing bath 72 and the first stabilization bath 74, the film FB for rapid processing can be delivered before the film FA for standard processing even in the case where the film FB is fed after the film FA. (See the processes A and B2 shown in the graph of FIG. 8B).

In this case, the control unit 50 calculates the position of the trailing end of the film FA along the direction of transportation thereof (the present position of the trailing end of the film FA can be determined from the feed rate and the time that the film FA passes the infrared sensor 40). The succeeding film FB begins to be transported at such a timing that it passes through the bypass formed by the second fixed guide member 84 while the film FA is running between the second bleach-fixing bath 70 and the first stabilization bath 74, and that the trailing end of the film FB about to enter the second stabilization bath 76 is substantially immediately followed by the forward end of the film FA along the direction of transportation thereof.

Further, according to this embodiment, the film FB can be delivered faster than in the above-mentioned method in which the film FA is outrun in the bypass formed by the second fixed guide 84. (See the processes A and B1 shown in the graph of FIG. 8B) According to this embodiment comprising the first coloring development bath 64 for developing the film FA for standard processing and the second coloring development bath 66 for developing the film FB for rapid processing, the film FA and the film FB can be developed concurrently.

More specifically, the distance by which the film FA is fed in the first coloring development bath 64 is three times longer than that of the film FB in the second coloring development bath 66. Even when the film FA is being processed in the first coloring development bath 64, therefore, the film FB that began to be processed later can be completely developed earlier in the second development bath 66. The film FB can thus be delivered even faster than by the method in which the film FA is outrun in the bypass formed by the second fixed guide 84.

In this method, it is necessary to send out the film FB to the processing section 62 as soon as the trailing end of the film FA along the direction of transportation is inserted into the processing section 62. Suppose that the film FB begins to be fed a predetermined time after the trailing end of the film FA along the direction of transportation is inserted in the processing section 62. The film FA and the film FB may interfere with each other between the first coloring development bath 64 and the second coloring development bath 66. In the case where the calculation indicates the likelihood of this interference, the processing is started still later to enable the film FA to be outrun in the bypass formed by the variable guide members 80.

As described above, according to this embodiment, films of different processing times which may be required to be processed concurrently can be processed efficiently within a short time.

Figure 8A:
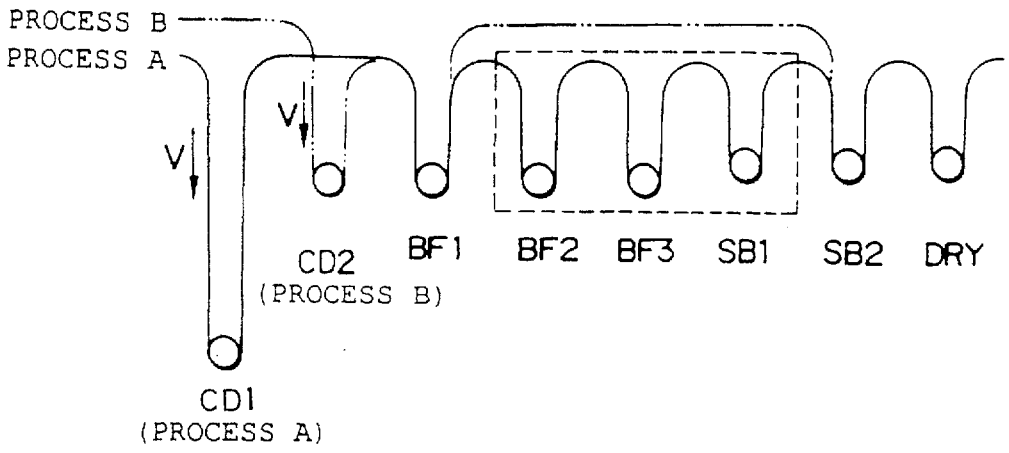
FIGS. 8A and 8B are diagrams for explaining the manner in which light-sensitive materials are fed in a light-sensitive material processing apparatus according to the second embodiment.
Figure 8B:
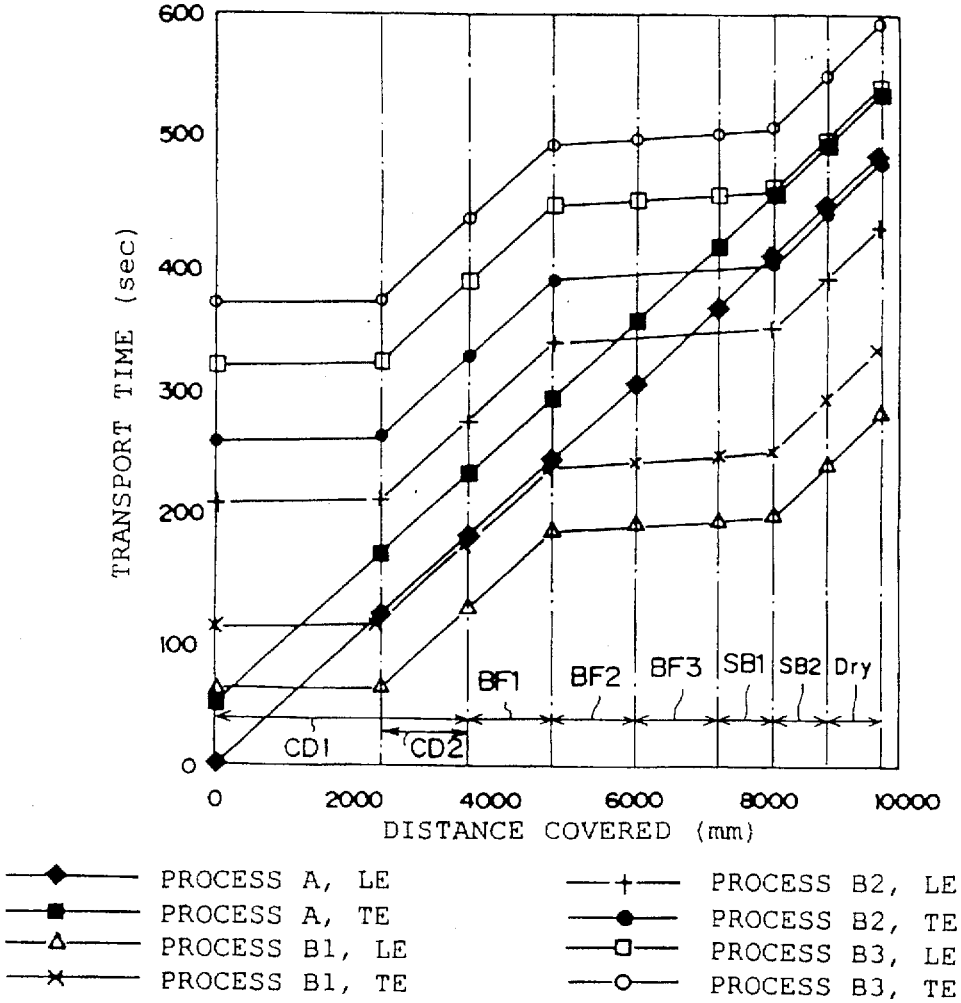

In FIGS. 8A and 8B, character CD1 designates a first coloring development bath 64, character CD2 a second coloring development bath 66, character BF1 a first bleach-fixing bath 68, character BF2 a second bleach-fixing bath 70, character BF3 a third bleach-fixing bath 72, character SB1 a first stabilization bath 74, character SB2 a second stabilization bath 76 and character DRY a drying section 78.

[Third embodiment]

Now, a third embodiment of the invention will be explained with reference to FIGS. 9 and 10. The same component parts as those in the above-mentioned embodiment are designated by the same reference numerals in this embodiment as the corresponding ones in the above-mentioned embodiments, respectively, and will not be described any further. In the light-sensitive material processing apparatus 61 according to this embodiment, the film F loader 36 of the light-sensitive material processing apparatus 60 according to the second embodiment is improved.

Figure 9:
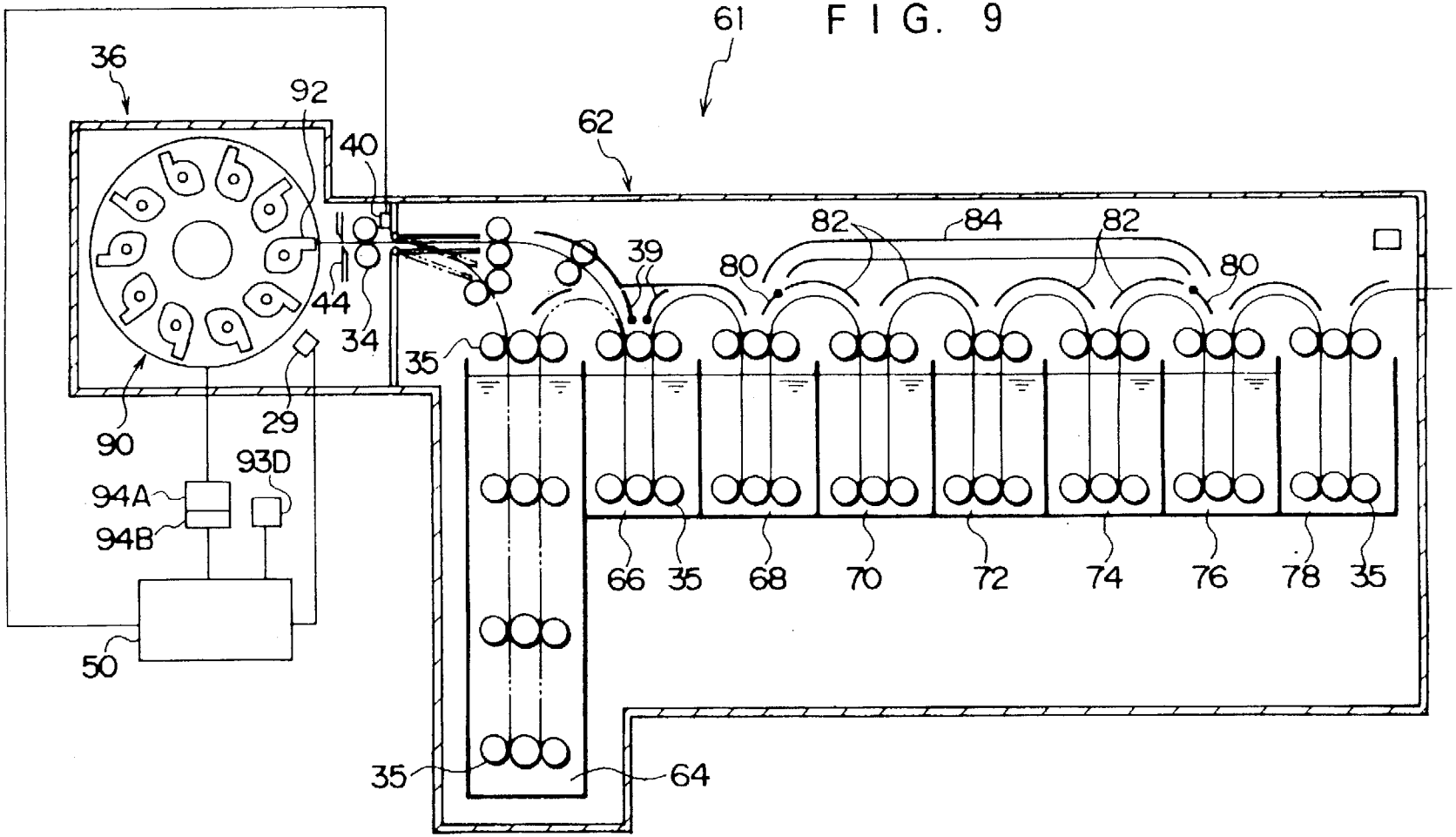
FIG. 9 is a diagram schematically showing a configuration of a light-sensitive material processing apparatus according to a third embodiment.

As shown in FIG. 9, in the film loader 36 according to this embodiment, a circular container 90 is removable by opening a cover not shown.

Figure 10:
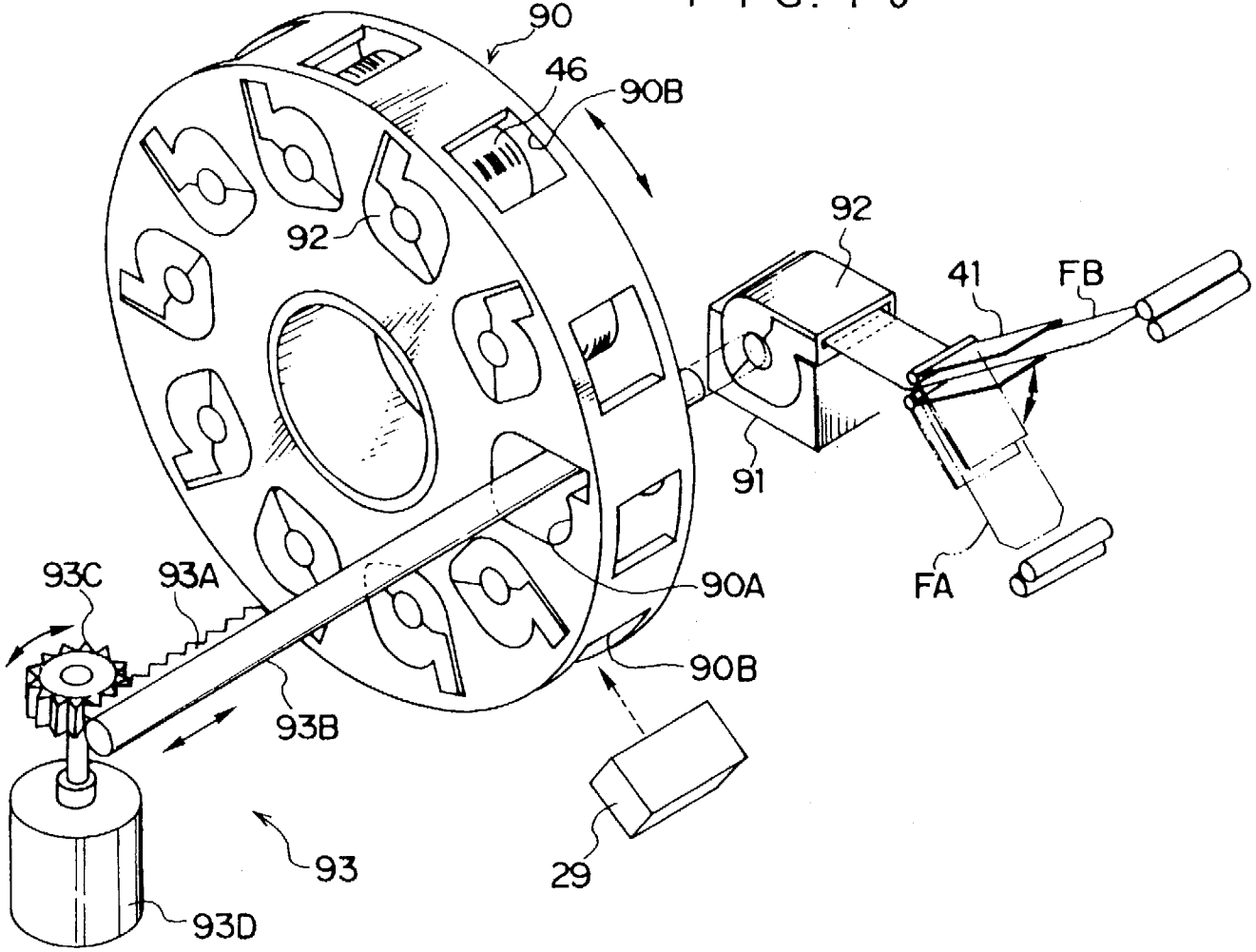
FIG. 10 is a perspective view showing the essential parts of a film loader.

As shown in FIG. 10, the container 90 includes a plurality of cartridge casings 90A, in each of which the cartridge 92 can be inserted.

The outer surface of the container 90 is formed with a window 90B associated with each of the cartridge casing 90A. The bar code 46 of the cartridge 92 is exposed from the window 90B.

An extruder 93 for extruding the cartridge 92 from the cartridge casing 90A to a cartridge holder 91 is arranged on the side of the container 90. The excluder 93 according to this embodiment includes an extrusion shaft 93B on which a rack 93A is mounted, a pinion gear 93C in mesh with the rack 93A and a motor 93D for rotating the pinion gear 93C. The motor 93D is controlled by the control unit 50 (not shown in FIG. 10).

As shown in FIG. 9, the film loader 36 includes a motor 94A for driving the container 90, an encoder 94B for detecting the rotational position of the container 90 and a motor (not shown) for driving the spool shaft of the cartridge 92. These component parts are connected to the control unit 50, which sequentially reads the bar codes 46 of the cartridges 92 while rotating the container 90, when the container 90 containing the cartridge 92 is loaded in the film loader 36. Thus the type of film contained in the cartridge 92 and the cartridge casing 90A containing the film are stored in memory.

Whenever it is decided that the film FA for standard processing and the film FB for rapid processing are coexistent in the container 90, the control unit 50 controls the whole operation in such a manner as to start processing the films FB for rapid processing by extruding them out of the cartridge holder 91, and upon complete delivery of all the films FB, successively begin to process the films FA.

As described above, according to this embodiment, the order of delivery of the films is automatically determined only by loading the container 90, so that the film FA and the film FB of different processing times can be processed in a short time.

While the embodiments of the present invention, as herein disclosed, constitute a preferred form, it is to be understood that other forms might be adopted.

What is claimed is:

1. A light-sensitive material processing method for processing at least two types of light-sensitive materials of different processing specifications, comprising the steps of:

producing the specification of a preceding first light-sensitive material, information on the transport path of the first light-sensitive material, the specification of a succeeding second light-sensitive material to be processed, and information on the transport path of the second light-sensitive material, and information on the trailing end position of the preceding first light-sensitive material;

calculating the processing start time of the second light-sensitive material in such a manner as to minimize the interval between the first light-sensitive material and the second light-sensitive material on the basis of said specifications and the transport path information of said first and second light-sensitive materials, and said trailing end position information of said first light-sensitive material; and starting the processing of said second-light sensitive material on the basis of the result of the calculation.

2. A light-sensitive material processing method according to claim 1, wherein said first light-sensitive material is for standard processing, and said second light-sensitive material is for rapid processing.

3. A light-sensitive material processing method according to claim 1, wherein the trailing end information of said first light-sensitive material is the information indicating the trailing end position of said first light-sensitive material along the direction of transportation on the transport path.

4. A light-sensitive material processing method according to claim 1, wherein the specifications of said first and second light-sensitive materials include at least the processing time of said light-sensitive materials and the total length of said light-sensitive materials.

5. A light-sensitive material processing method according to claim 1, wherein said transport path information includes at least the position and length of said transport path and the feed rate of said light-sensitive materials.

6. A light-sensitive material processing apparatus for processing at least two types of light-sensitive materials of different processing times, comprising:

means for processing the light-sensitive materials; and means for transporting the light-sensitive materials disposed within said processing means, said transporting means comprising a plurality of blocks along the direction of transportation of the light sensitive materials, a transporting speed of each of said plurality of blocks being independently variable so that each of said plurality of blocks can be driven at respectively different speeds.

7. A light-sensitive material processing apparatus for processing at least two types of light-sensitive materials of different processing times, comprising:

a plurality of processing baths for storing the solutions for processing the light-sensitive materials, the processing baths including a plurality of development baths and a plurality of stabilization baths;

first transport means for transporting the light-sensitive materials through the processing baths in a predetermined order; and second transport means arranged in parallel with the first transport means for transporting the light-sensitive materials in such a manner as to skip a predetermined one of the processing baths.

8. A method of processing at least two types of light-sensitive materials of different processing times, comprising the step of processing light-sensitive materials of short processing time earlier than light-sensitive materials of long processing time.

9. A light-sensitive material processing apparatus for processing at least two types of light-sensitive materials of different processing times including standard processing type and rapid processing type, comprising:

a container rotatable within a film loader and including a plurality of cartridge casings into each of which a cartridge having a light-sensitive material therein is inserted;

an information reader-sensor for reading the information from the cartridge inserted in said cartridge casing;

an extruder arranged on the side of the container for extruding the cartridge from said cartridge casing to a cartridge holder under the control of a control means; and the control means for causing said information reader-sensor to read each information from said cartridge while rotating said container, sequentially starting to process by extruding said light-sensitive materials for rapid processing to said cartridge holder, and continuing to process the light-sensitive materials for standard processing after complete delivery of all the light-sensitive materials for rapid processing.

10. A light-sensitive material processing apparatus for processing at least two types of light-sensitive materials of different processing times, comprising:

transport means divided into a plurality of blocks for transporting said light-sensitive materials along the direction of transportation thereof, each of said blocks being variable in feed rate; and control means for calculating the processing start time of a second light-sensitive material about to be processed and starting to process the second light-sensitive material in such a manner as to minimize the interval between a first light-sensitive material fed in advance and the second light-sensitive material on the basis of the specification of the first light-sensitive material fed in advance of said second light-sensitive material by said transport means, information on the transport path of the first light-sensitive material, the specification of a succeeding second light-sensitive material about to be processed, and information on the transport path of the second light-sensitive material fed by said transport means, and information on the trailing end position of the preceding first light-sensitive material.

11. A light-sensitive material processing apparatus according to claim 10, wherein said first light-sensitive material is of standard processing type and said second light-sensitive material is of rapid processing type.

12. A light-sensitive material processing apparatus according to claim 10, wherein said information on the trailing end position of said first light-sensitive material indicates the position of the trailing end of said first light-sensitive material along the direction of transportation on said transport path.

13. A light-sensitive material processing apparatus according to claim 10, wherein the specifications of said first and second light-sensitive materials include at least the processing time and the total length of said light sensitive-materials.

14. A light-sensitive material processing apparatus according to claim 10, wherein said transport path information includes at least the position and length of said transport path and the feed rate at which said light-sensitive materials are transported by said transport means.

15. A light-sensitive material processing apparatus for processing at least two types of light-sensitive materials of different processing times, comprising:

a plurality of processing baths for storing processing solutions for processing a preceding first light-sensitive material for standard processing being transported and a succeeding second light-sensitive material for rapid processing to be transported;

first transport means for transporting said first light-sensitive material through a plurality of said processing baths in a predetermined order of sequence;

second transport means arranged in parallel with said first transport means for transporting said second light-sensitive material in such a manner as to skip a predetermined one of said processing baths; and control means for calculating the processing start time of the second light-sensitive material and starting to process said second light-sensitive material in such a manner as to minimize the interval between the first light-sensitive material and the second light-sensitive material on the basis of the specification of the first light-sensitive material fed in advance of said second light-sensitive material, information on the transport path of the first light-sensitive material, the specification of the succeeding second light-sensitive material about to be processed, and information on the transport path of the second light-sensitive material, and information on the trailing end position of the preceding first light-sensitive material.

16. A light-sensitive material processing apparatus according to claim 15, wherein said information on the trailing end position of said first light-sensitive material indicates the position of said trailing end along the direction in which said first light-sensitive material is fed on said transport path.

17. A light-sensitive material processing apparatus according to claim 15, wherein the specifications of said first and second light-sensitive materials include at least the processing time and the total length of said light sensitive-materials.

18. A light-sensitive material processing apparatus according to claim 15, wherein said transport path information includes at least the position and length of said transport path and the feed rate of said light-sensitive materials.

19. A light-sensitive material processing apparatus according to claim 6, further comprising means for controlling the transporting speed of each of said plurality of blocks.

20. A light-sensitive material processing apparatus according to claim 19, wherein each block comprises a plurality of rollers.

* * * * *